United States Patent [19]

Iwasaki et al.

[11] 4,122,316

[45] Oct. 24, 1978

[54] PUSH BUTTON SWITCH ASSEMBLY HAVING INDEPENDENT OPERATOR INTERLOCK IN AT LEAST TWO ROWS LATCHING AT LEAST ONE OPERATOR

[75] Inventors: Sadayoshi Iwasaki; Shinya Naganuma, both of Furukawa, Japan

[73] Assignee: Alps Electric Co., Ltd., Japan

[21] Appl. No.: 758,592

[22] Filed: Jan. 12, 1977

[30] Foreign Application Priority Data

Jan. 28, 1976 [JP] Japan ..... 51-8245[U]
Jan. 28, 1976 [JP] Japan ..... 51-8246[U]

[51] Int. Cl.[2] ..... H01H 9/26; G05G 11/00

[52] U.S. Cl. ..... 200/5 B; 200/5 E; 200/50 C; 74/483 PB

[58] Field of Search ..... 200/5 R, 5 B, 5 E, 5 EA, 200/5 EB, 50 C, 5, 50; 74/483 PB

[56] References Cited

U.S. PATENT DOCUMENTS

| | | | |
|---|---|---|---|
| 3,544,739 | 12/1970 | Shoh | 200/5 E |
| 3,719,786 | 3/1973 | Mallett et al. | 200/5 EB |
| 3,722,313 | 3/1973 | Schadow | 200/5 E X |
| 3,778,564 | 12/1973 | Nocella | 200/5 E X |
| 3,889,075 | 6/1975 | Morrell et al. | 200/5 E |
| 3,927,283 | 12/1975 | Kunimine | 200/5 E X |

FOREIGN PATENT DOCUMENTS

| | | | |
|---|---|---|---|
| 2,142,802 | 2/1973 | Fed. Rep. of Germany | 74/483 PB |

*Primary Examiner*—James R. Scott
*Attorney, Agent, or Firm*—Guy W. Shoup; Gerard F. Dunne

[57] ABSTRACT

First and second switch blocks comprising a plurality of first and second push button switches respectively are connected together in parallelism and in mirror symmetry and are provided with first and second latch bars common to the first and second switches respectively. The switch blocks are held together by detachable connectors which, in turn, support pivotal levers. The levers engage the ends of the switch block latch bars and cause interlocking of any pushbutton switch or switches in the depressed position and unlatch any previously depressed pushbutton switch or switches in either the first or second switch blocks.

15 Claims, 13 Drawing Figures

PUSH BUTTON SWITCH ASSEMBLY HAVING INDEPENDENT OPERATOR INTERLOCK IN AT LEAST TWO ROWS LATCHING AT LEAST ONE OPERATOR

BACKGROUND OF THE INVENTION

The present invention relates to a push button switch assembly.

Push button switch assemblies which are currently in general use typically comprise a plurality of push button switches provided in a single row and a latch means for the push buttons of the switches. In operation, the push button of a selected switch is depressed and is latched in the depressed position by the latch means. Depression of the push button of another switch causes the depressed push button to be latched in the depressed position and the push button of the switch which was previously depressed to be unlatched or released. Such push button switch assemblies are in widespread use in automobile radios for station selection and in industrial switching applications. However, push button switch assemblies comprising two or more rows of switches which are simple and inexpensive to manufacture have heretofore not been available.

Whereas AM-only or FM-only automobile radios usually incorporate such a push button switch assembly, AM-FM automobile radios generally comprise an AM-FM selector switch and a tuning knob, due to the unavailability of suitable push button switch assemblies comprising two rows of switches. Such currently available AM-FM automobile radios require more driver attention for station selection and tuning than push button radios, and constitute a driving safety hazard. The unavailability of suitable push button switch assemblies comprising two or more rows of switches has also led to the incorporation of less desirable expedients in industrial switching applicaitons.

SUMMARY OF THE INVENTION

The present invention basically consists of first and second push button switch blocks each comprising a plurality of push button switches which are connected together in a unique manner to function as a single switch block. By omission of certain elements, the switches of either the first or second switch blocks may be actuated without affecting the switches of the other first or second switch block.

It is an object of the present invention to provide a push button switch assembly comprising two or more rows of switches which are interconnected in a simple but unique manner.

It is another object of the present invention to provide a push button switch assembly comprising two rows of push button switches in which depression of the push button of any switch causes the depressed push button to be latched in the depressed position and the push buttons of any other switches which were previously depressed to be unlatched.

It is another object of the present invention to provide a push button switch assembly comprising first and second rows of push button switches in which depression of the push button of any of the first switches will latch the depressed push button in the depressed position and unlatch the push button of any first switch which was previously depressed but will not affect the second switches. However, depression of the push button of any of the second switches will latch the depressed push button in the depressed position and unlatch the push button of any other first or second switch which was previously depressed.

It is another object of the present invention to provide a generally improved push button switch assembly.

Other objects, together with the foregoing, are attained in the embodiments described in the following description and illustrated in the accompanying drawings.

DESCRIPTION OF THE PREFERRED EMBODIMENTS

While the push button switch assembly of the invention is susceptible of numerous physical embodiments, depending upon the environment and requirements of use, substantial numbers of the herein shown and described embodiments have been made, tested and used, and all have performed in an eminently satisfactory manner.

Figure 1:
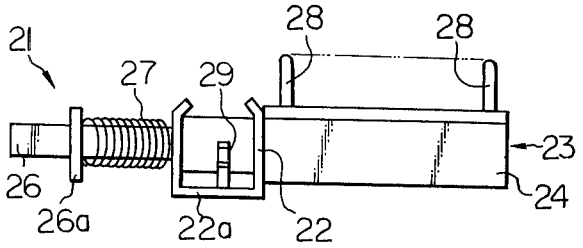
FIG. 1 is a longitudinal schematic view of a switch block of a push button switch assembly embodying the present invention.
Figure 2:
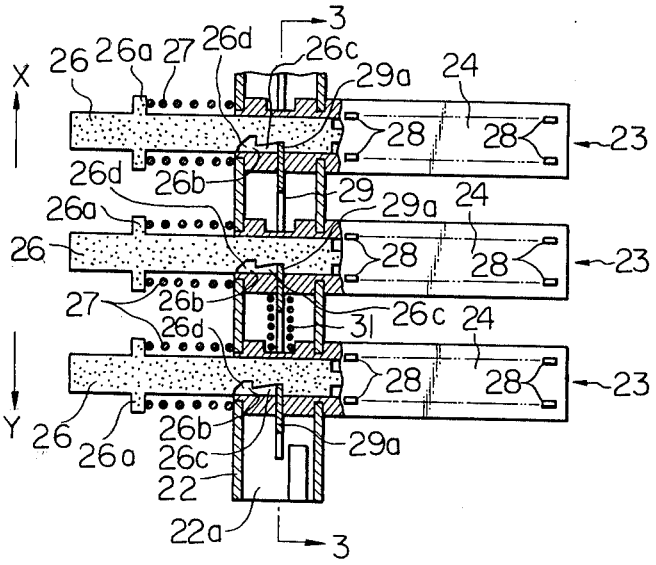
FIG. 2 is an overhead fragmentary schematic view, partly in cross section, of the switch block shown in FIG. 1.
Figure 3:
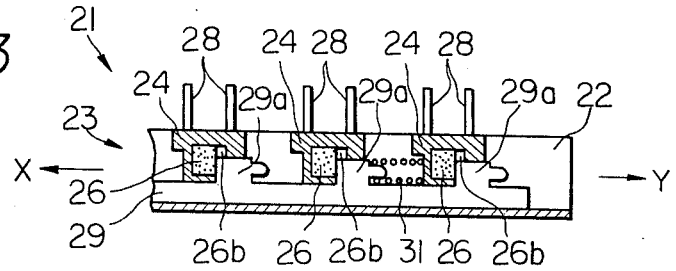
FIG. 3 is a fragmentary sectional view taken on a line 3—3 in FIG. 2.
Figure 4:
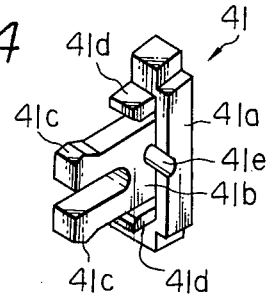
FIG. 4 is a perspective view of a connector of the switch assembly.
Figure 5:
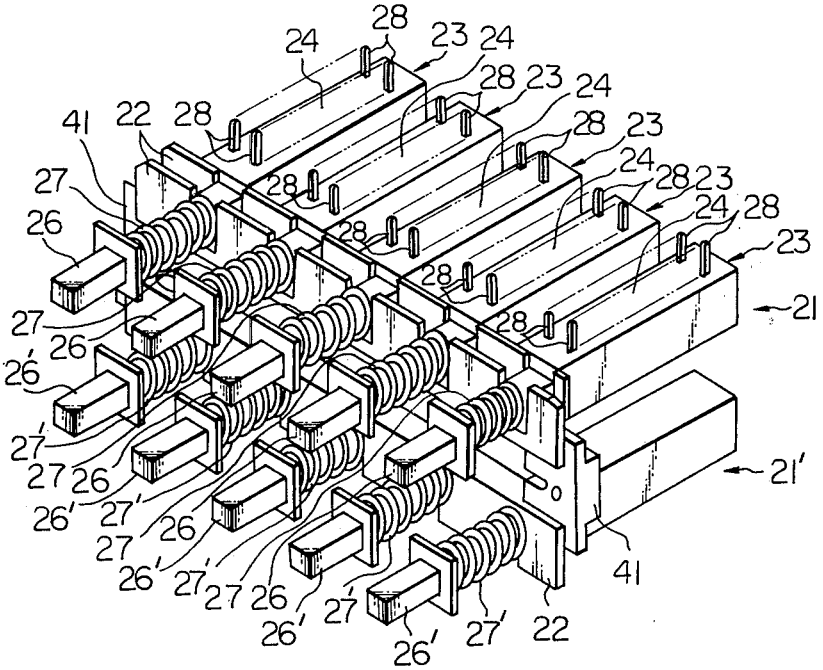
FIG. 5 is a perspective view of two switch blocks connected together in parallelism and in mirror symmetry by two connectors as shown in FIG. 4.
Figure 6:
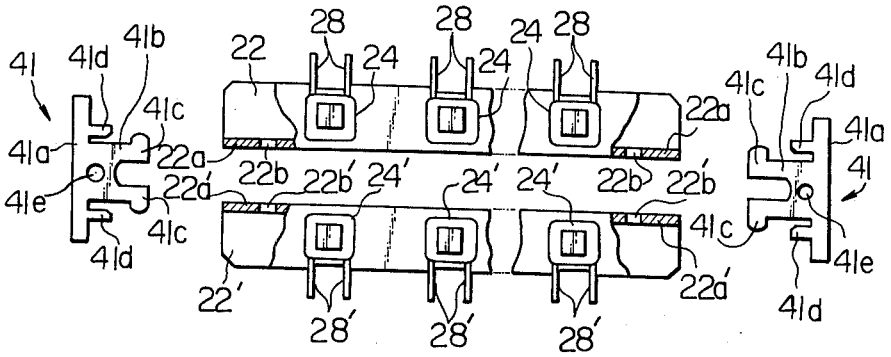
FIG. 6 is an exploded fragmentary front schematic view of the switch blocks and connectors.

Referring now to FIGS. 1 to 3 of the drawing, a switch block 21 comprises a generally U-shaped frame 22 which fixedly supports a plurality of push button switches 23. Each switch 23 comprises a body 24, a push button actuator 26 and a compression spring 27 provided between a lip **26*a* of the push button 26 and the frame 22 urging the push button 26 away from the body 24**.

The internal construction of the switches 23 is not the subject matter of the present invention and will not be described in detail. The switches 23 each comprise a plurality of fixed contacts mounted inside the housing 24 which are not visible in the drawing but which lead out of the body 24 to terminals 28. The push button 26 slidably intrudes into the body 24 and actuates a plurality of movable contacts, which are likewise not visible in the drawing, which engage with the fixed contacts.

The retracted position of the push button 26 shown in FIGS. 1 and 2 constitutes a first switch position. A depressed position of the push button 26 constitutes a second switch position in which different terminals are ohmically connected or disconnected by the internal contacts.

Each push button 26 of the switch block 21 is formed at one edge, shown as the lower edge in FIG. 2, with a cutout 26*b*, which comprises a right generally right triangular portion 26*c* and a left generally right triangular portion 26*d* which is deeper than the portion 26*c*. As viewed in FIG. 3, a latch bar 29 is formed with a plurality of latch members 29*a* which engage in the cutouts 26*b* of the push buttons 26 and is slidably supported by the frame 22 for movement parallel thereto.

A compression spring 31 urges the latch plate 29 in a direction designated as X toward a latching position whereby the latch members 29*a* move toward the cutouts 26*b* respectively. The latch bar 29 is movable in a direction designated as Y against the force of the spring 31 in which the latch members 29*a* move away from the cutouts 26*b* respectively.

As best seen in FIG. 2, all of the push buttons 26 are in the undepressed position and the latch members 29*a* are engaged in the triangular portions 26*c* of the cutouts 26*b*. More specifically, the springs 27 urge the push buttons 26 leftwardly so that the right edges of the cutouts 26*c* abut against the latch members 29*a* to prevent further leftward movement of the push buttons 26 to hold the push buttons 26 in the undepressed positions. If, however, a push button 26 is moved rightwardly against the force of the respective spring 27, the slanted edge of the cutout 26*c* through engagement with the respective latch member 29*a* will cause the latch bar 29 to move in the direction Y against the force of the spring 31. Further depression of the push button 26 will cause the triangular portion 26*c* of the cutout 26*b* to move past the latch member 29*a* and the spring 31 will urge the latch bar 29 in the direction X so that the latch member 29*a* will drop down into the triangular portion 26*d* of the cutout 26*b*. When the push button 26 is released, the right edge of the triangular portion 26*d* will abut against the latch member 29*a* preventing leftward movement of the push button and latching the push button 26 in the depressed position.

When another push button 26 is subsequently depressed, the latch bar 29 will be moved in the direction Y thereby in the manner described above. Just as the right edge of the triangular portion 26*d* of the cutout 26*b* of the subsequently depressed push button 26 reaches the respective latch member 29*a*, the latch member 29*a* corresponding to the previously depressed push button 26 will reach the outer tip of the right edge 26*d* of the respective cutout 26*b* so that the latch member 29*a* will release the previously depressed push button 26 and the respective spring 27 will move the previously depressed push button 26 to the undepressed position. In summary, depression of any push button 26 will latch the depressed push button 26 in the depressed position and unlatch any previously depressed push button 26 so that the previously depressed push button 26 will be returned to the undepressed position thereof.

Referring now to FIGS. 4 to 7, the switch block 21 is connected to an identical switch block 21' in parallelism and mirror image symmetry. The corresponding elements of the switch block 21' are designated by the same reference numerals as the switch block 21 suffixed by an apostrophe.

The switch blocks 21 and 21' are placed together back to back so that bottom walls 22*a* and 22*a'* of the frames 22 and 22' face each other. The bottom walls 22*a* and 22*a'* are formed with cutouts 22*b* and 22*b'* respectively spaced slightly from the ends thereof. Two connecting members 41, one of which is shown in detail in FIG. 4, each comprise a base portion 41*a* from which perpendicularly extends a bifurcated projection 41*b*. The bifurcated ends of the projection 41*b* are formed with tabs 41*c*.

Figure 7:
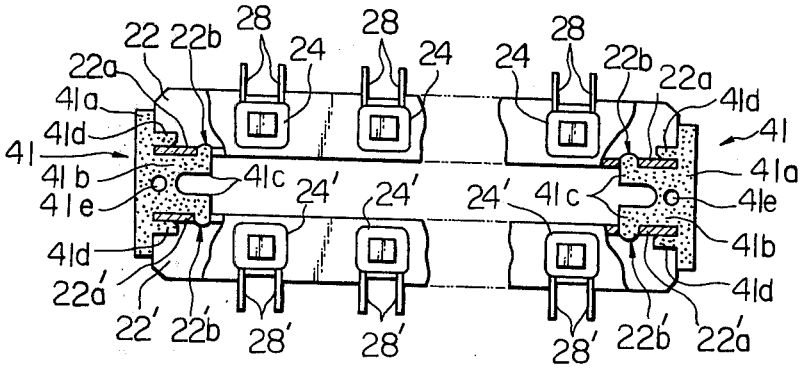
FIG. 7 is a fragmentary front schematic view showing the switch blocks and connectors assembled.

As best seen in FIG. 7 the two connectors 41 are assembled with the adjacent left and right ends of the frames 22 and 22' to rigidly but detachably fix the frames 22 and 22' together. More specifically, the projection 41*b* engages with the bottom walls 22*a* and 22*a'* to space the frames 22 and 22' from each other by a distance equal to the width of the projection 41*b*. The tabs 41*c* engage in the cutouts 22*b* and 22*b'* to prevent the connectors 41 from being axially detached from the frames 22 and 22'. In addition, the connectors 41 are formed with projections 41*d* on opposite sides of the projection 41*b* to prevent the frames 22 and 22' from being transversely pulled away from each other.

Figure 8:
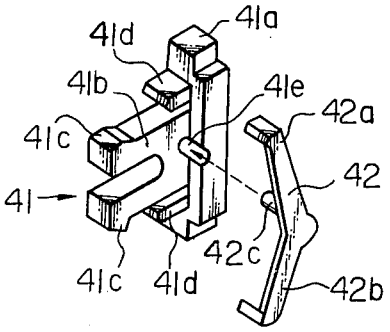
FIG. 8 is an exploded perspective view showing a connector and a lever adapted to be assembled with the connector for pivotal support thereby.
Figure 9:
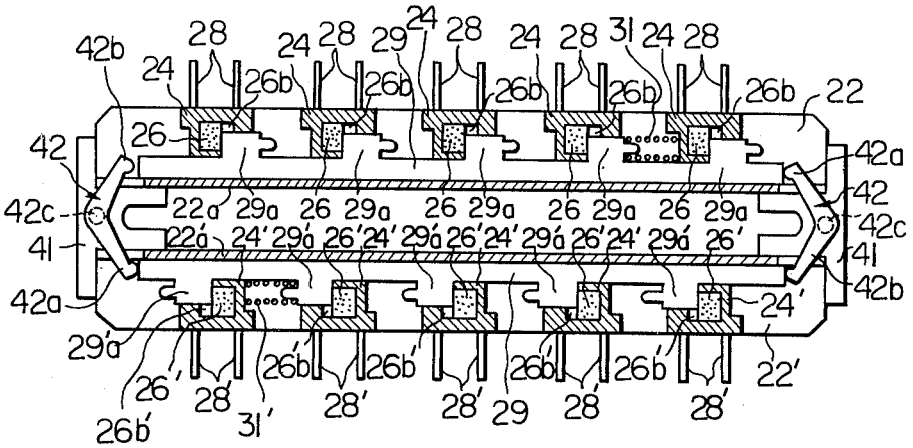
FIG. 9 is a front schematic view illustrating the assembled push button switch assembly.

The connectors 41 are made of a resilient material such as plastic and the spacing between the projections 41*d* and the projection 41*b* is selected to be slightly less than the thickness of the bottom walls 22*a* and 22*a'*. The bottom walls 22*a* and 22*a'* are thereby resiliently gripped between the projections 41*b* and 41*d*. To assemble the switch blocks 21 and 21' by means of the connectors 41, the tabs 41*c* are resiliently deformed toward each other and the connectors 41 are pushed onto the frames 22 and 22' from the position of FIG. 6 to the position of FIG. 7. The tabs 41*c* are resiliently urged to pop into the cutouts 22*b* and 22*b'* upon alignment therewith so that the frames 22 and 22' are firmly held together. Due to the resilience of the connectors 41, the frames 22 and 22' may be disassembled by strongly pulling the connectors 41 off the frames 22 and 22'. The connectors 41 are further formed with holes 41*e* which extend perpendicular to the projections 41*b*. As best seen in FIGS. 8 and 9, the two identical pivotal levers 42 each comprise two arms 42*a* and 42*b* which meet at an angle and a pin 42*c* extending perpendicularly from the junction of the arms 42*a* and 42*b*. The pins 42*c* fit into the holes 41*e* of the connectors 41 in such a manner that the levers 42 are pivotally supported by the connectors 41.

The connectors 41 and therefore the levers 42 are provided at opposite ends of the frames 22 and 22'. As best seen in FIG. 9, the end of the arm 42*a* of the rightmost lever 42 engages with the rightmost end of the latch bar 22 and the end 42*b* of the rightmost lever 42 engages with the rightmost end of the latch bar 22'. Similarly, the end of the arm 42*b* of the leftmost lever 42 engages with the leftmost end of the latch bar 22 and the end of the arm 42*a* of the leftmost lever 42 engages with the leftmost end of the latch bar 22'.

When the push button 26 of any switch 23 is depressed the latch bar 29 is moved rightwardly in FIG. 9 against the force of the spring 31. Since the rightmost end of the latch bar 29 is in engagement with the arm 42*a* of the rightmost lever 42, rightward movement of the latch bar 29 will cause the rightmost lever 42 to pivot clockwise about the pin 42*c* thereof. Since the arm 42*b* of the rightmost lever 42 is in engagement with the rightmost end of the latch bar 29', the latch bar 29' will be urged by the rightmost lever 42 to move leftwardly against the force of the spring 31'. Since the latch bars 29 and 29' are both moved to their respective unlatched positions through depression of the depressed push button 26, the result is that the depressed push button 26 will be latched in the depressed position and the push button 26 or 26' of any switch 23 or 23' which was previously depressed will be unlatched and be moved by the respective spring 27 or 27' to the undepressed position. It will be noted that since the arm **42*a* of the leftmost lever 42 is in engagement with the leftmost end of the latch bar 29' the leftmost lever 42** will be pivoted clockwise during this operation.

When the push button 26' of any switch 23' is depressed the latch bar 29' is moved leftwardly against the force of the spring 31'. Since the leftmost end of the latch bar 29' is in engagement with the arm **42*a* of the leftmost lever 42, leftward movement of the latch bar 29' will cause the leftmost lever 42 to pivot clockwise about the pin 42*c* thereof. Since the arm 42*b* of the leftmost lever 42 is in engagement with the leftmost end of the latch bar 29, the latch bar 29 will be urged by the leftmost lever 42 to move rightwardly against the force of the spring 31. Since the latch bars 29' and 29 are both moved to their respective unlatched positions through depression of the depressed push button 26', the result is essentially similar to that described with reference to depression of a push button 26. The depressed push button 26' will be latched in the depressed position and the push button 26 or 26' of any switch 23 or 23' which was previously depressed will be unlatched and be moved by the respective spring 27 or 27' to the undepressed position. In this case, since the arm 42*b* of the rightmost lever 42 is in engagement with the rightmost end of the latch bar 29 the rightmost lever 42** will be pivoted clockwise during this operation.

In summary, it will be understood that the unique configuration of the levers 42 which are pivotally supported by the respective connectors 41 at the opposite ends of the switch blocks 21 and 21' serve to interconnect the switches 23 and 23' for integral operation. In other words, the switch blocks 21 and 21' operate as a single switch block.

Figure 10:
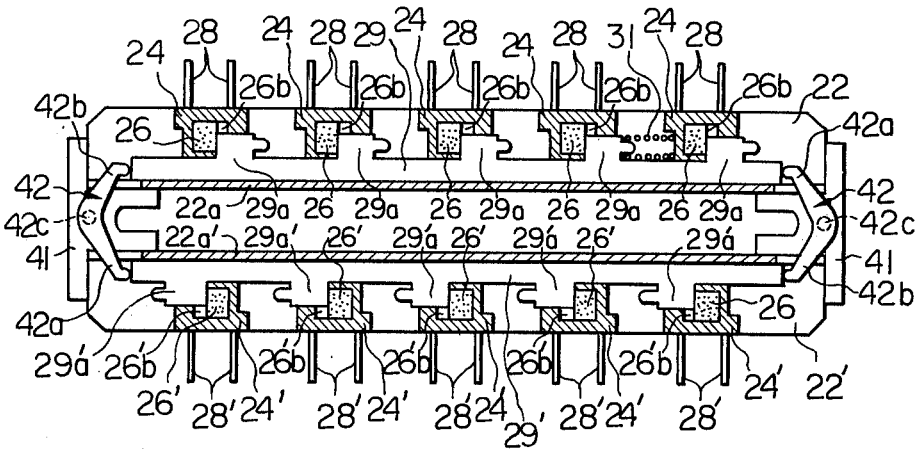
FIG. 10 is similar to FIG. 9 but shows a modification in which a spring is omitted.

FIG. 10 shows a modification of the embodiment of FIG. 9 in which the spring 31' is omitted. In this case the latch bar 29' is moved to the latched position by the spring 31 through the leftmost lever 42. The operation of the embodiment of FIG. 10 is otherwise identical to that of FIG. 9.

Figure 11:
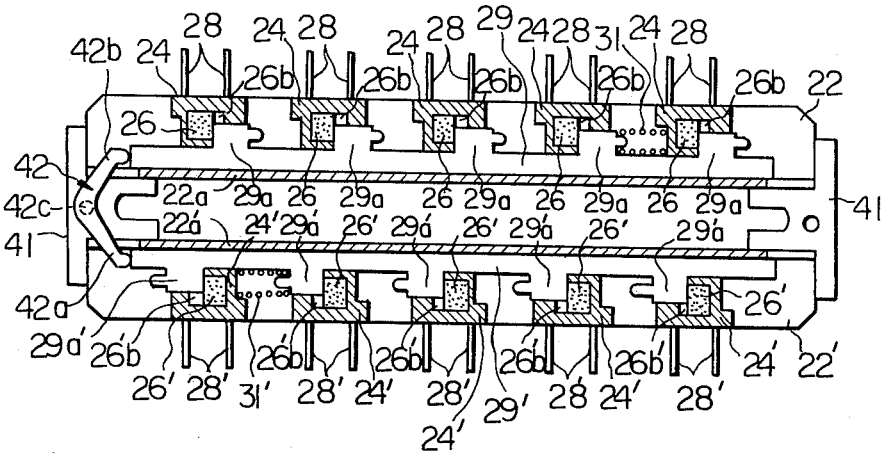
FIG. 11 is similar to FIG. 9 but shows a modification in which a lever is omitted.

FIG. 11 shows another modification of the embodiment of FIG. 9 in which the rightmost lever 42 is omitted. In this embodiment depression of the push buttons 26' of any switch 23' will latch the depressed push button 26' and unlatch any push button 26 or 26' which was previously depressed by means of the leftmost lever 42 in the manner described above. However, since the rightmost lever 42 is omitted, rightward movement of the latch bar 29 is not transmitted to the latch bar 29'. In other words, depression of any push button 26 will latch the depressed push button 26 and unlatch any push button 26 previously depressed but will not affect the push buttons 26'. The switches 23 may therefore be changed over independently of, or not affecting the switches 23'. However, changeover of any switch 23' unlatches the depressed push button 26 of any switch 23 in addition to unlatching the depressed push button 26' of any switch 23'.

Figure 12:
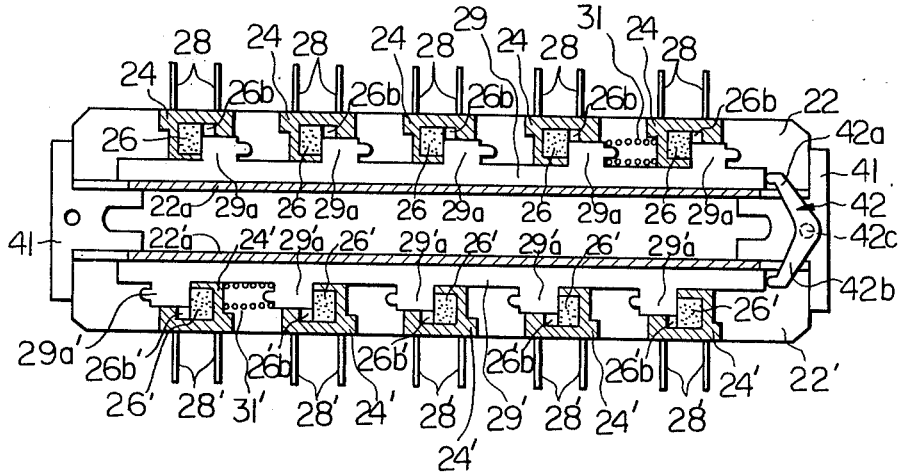
FIG. 12 is similar to FIG. 9 but shows a modification in which a different lever is omitted.

The embodiment of FIG. 12 is similar to the embodiment of FIG. 11 except that the leftmost lever 42 is omitted rather than the rightmost lever 42 so that leftward movement of the latch bar 29' is not transmitted to the latch bar 29. Therefore, the switches 23' rather than the switches 23 may be actuated independently. The operation of the embodiment of FIG. 12 is essentiallly similar to that of the embodiment of FIG. 11 except that depression of a push button 26 will unlatch any previously depressed push botton 26 or 26' but depression of a push button 26' will only unlatch a previously depressed push button 26'.

Figure 13:
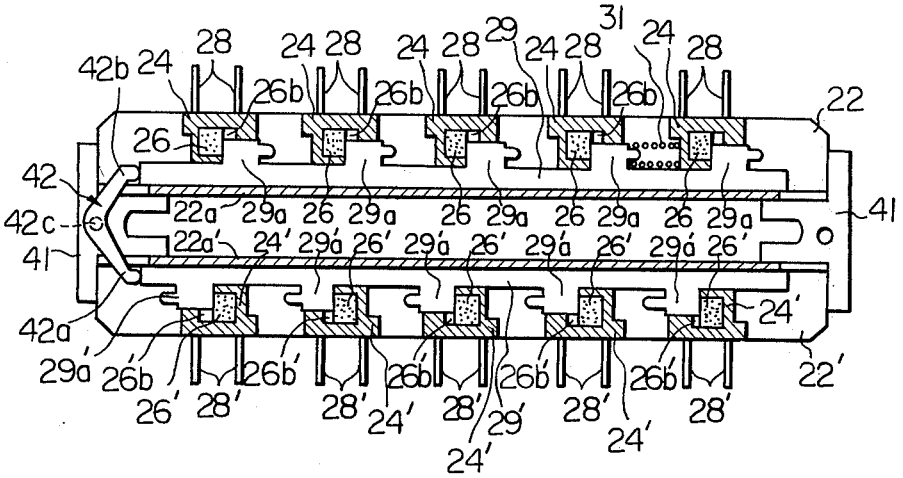
FIG. 13 is similar to FIG. 9 but shows a modification in which a spring and a lever are omitted.

The embodiment of FIG. 13 is similar to the embodiment of FIG. 11 except that in addition to the omission of the rightmost lever 42 the spring 31' is also omitted. The operation of the embodiment of FIG. 13 is essentially similar to that of the embodiment of FIG. 11 except that the positive biasing action of the spring 31' urging the latch bar 29' toward the latching position is not provided.

In summary, it will be seen that the present invention provides a push button switch assembly comprising two rows of push button switches which are interconnected in a simple but unique manner and can be programmed to provide various switching functions by the mere omission of various elements. Many modifications, such as providing the switch assembly with more than two rows of switches, will become possible for those skilled in the art after receiving the teachings of the present disclosure without departing from the scope thereof.

What is claimed is:

1. A switch assembly comprising:

a first switch block including a first frame member, a plurality of first push button switches supported by said first frame member, a first latch member common to and engaging said first switches and a first spring operatively associated with said first latch member for urging said first latch member toward a position latching said first switches;

a second switch block arranged generally parallel to said first switch block, said second switch block including a second frame member, a plurality of second push button switches supported by said second frame member and a second latch member common to and engaging said second switches, said second latch member being adapted to move into a position latching said second switches;

means for detachably connecting the end portions of said first frame member to adjacent end portions of said second frame member, said connecting means including first and second connector members each comprised of a resilient material and including portions detachably and resiliently interfitting with respective adjacent end portions of said frame members; and a first lever pivotally connected to one of said connector members and having generally opposing end portions thereof engaging with first adjacent ends of said first and second latch members respectively in such a manner that movement of said second latch member in one direction away from a latching position is transmitted through said first lever by a pivotal movement thereof to said first latch member causing said first latch member to move in the other direction away from the latching position thereof against the force of said first spring.

2. A switch assembly as in claim 1, further comprising a second spring urging the second latch member toward the latching position thereof.

3. A switch assembly as in claim 2, in which the first and second springs are compression springs.

4. A switch assembly as in claim 1, further comprising a second lever pivotally connected to the other of said connector members and having opposing end portions thereof engaging with second adjacent ends of said first and second latch members respectively in such a manner that movement of said first latch member in said other direction away from the latching position thereof is transmitted through said second lever by a pivotal movement thereof to said latch member causing said second latch member to move in said one direction away from the latching position thereof.

5. A switch assembly as in claim 4, further comprising a second spring urging said second latch member toward the latching position thereof.

6. A switch assembly as in claim 1, in which the first and second switch blocks are identical and are connected together in parallelism and in mirror image symmetry.

7. A switch assembly as in claim 1, in which the first and second latch members are axially movably supported by the first and second frames respectively.

8. In a switch assembly comprising a first switch block including a first frame member and a plurality of push button switches supported thereby, and a second switch block arranged generally parallel to said first switch block and including a second frame member and a plurality of push button switches supported thereby, the improvement comprising:

first and second connector members each comprised of a resilient material and adapted to detachably connect a respective end portion of said first frame member to an adjacent end portion of said second frame member; and coacting means formed respectively on said connector members and the end portions of said frame members connected thereto for detachably and securely engaging said connector members to said end portions by the resilience of said connector members.

9. A switch assembly according to claim 8, said coacting means including cutout portions in said end portions and projecting tab portions of said connecting members.

10. A switch assembly according to claim 9, said first and second connector members each comprising:

a base portion;

a bifurcated projection extending perpendicularly from said base portion, each leg of said projection carrying a respective tab portion; and projections extending perpendicularly from said base portion at locations spaced outward from said bifurcated projection, said end portions being gripped in the space between said bifurcated projection and respective projections.

11. In a switch comprising a first switch block including a first frame member, a plurality of first push button switches supported by said first frame member and a first latch member engaging each of said first switches and adapted to be moved in its plane to a position unlatching any first switch upon depressing one of the unlatched first switches; and a second switch block arranged generally parallel to said first switch block and including a second frame member, a plurality of second push button switches supported by said second frame member and a second latch member engaging each of said second switches and adapted to be moved in its plane to a position unlatching at least any second switch upon depressing one of the unlatched second switches; the improvement comprising:

first and second connector members each comprised of a resilient material and adapted to detachably connect a respective end portion of said first frame member to an adjacent end portion of said second frame member;

coacting means formed respectively on said connector members and the end portions of said frame members connected thereto for detachably and securely engaging said connector members to said end portions by the resilience of said connector members; and a first lever pivotally connected to said first connector member and engaging adjacent ends of said first and second latch members in such a manner that movement of the second latch member by depressing an unlatched second switch is transmitted through said first lever to said first latch member causing said first latch member to its unlatching position.

12. A switch assembly according to claim 11, further comprising a second lever pivotally connected to said second connector member and engaging adjacent ends of said first and second latch members in such a manner that movement of the first latch member by depressing an unlatched first switch is transmitted through said second lever to said second latch member causing said second latch member to its unlatching position.

13. A switch assembly according to claim 11, said first and second switch blocks being identical and connected together in mirror image symmetry.

14. A switch assembly according to claim 11, said first lever having first and second arm portions extending generally oppositely from the connection of said first lever to said first connector member in such a manner that said first arm portion engages the end of said first latch member and said second arm portion engages the end of said second latch member.

15. A switch assembly according to claim 14, further comprising a second lever pivotally connected to said second connector member and engaging adjacent ends of said first and second latch members in such a manner that movement of the first latch member by depressing an unlatched first switch is transmitted through said second lever to said second latch member causing said second latch member to its unlatching position;

said second lever having first and second arm portions extending generally oppositely from the connection of said second lever to said second connector member in such a manner that said first arm portion engages the other end of said first latch member and the second arm portion engages the other end of said latch member.

* * * * *